United States Patent [19]

Pace

[11] Patent Number: 5,075,832

[45] Date of Patent: Dec. 24, 1991

[54] SAFETY STRAP

[76] Inventor: Ronald Pace, 8086 Old French Rd., Erie, Pa. 16509

[21] Appl. No.: 435,605

[22] Filed: Nov. 13, 1989

[51] Int. Cl.[5] ..... F21V 15/00

[52] U.S. Cl. ..... 362/376

[58] Field of Search ..... 362/376, 377, 378

[56] References Cited

U.S. PATENT DOCUMENTS

| | | | |
|---|---|---|---|
| 2,687,516 | 8/1954 | Schneiderman | 362/377 |
| 3,172,608 | 3/1965 | Ausman | 362/376 |
| 3,194,958 | 7/1965 | Schneiderman | 362/376 |
| 3,935,560 | 1/1976 | Dorn | 362/378 |
| 4,514,793 | 4/1985 | Andreasen | 362/377 |

FOREIGN PATENT DOCUMENTS

| | | | |
|---|---|---|---|
| 711126 | 6/1965 | Canada | 362/376 |
| 603893 | 9/1934 | Fed. Rep. of Germany | 362/376 |

*Primary Examiner*—Ira S. Lazarus
*Assistant Examiner*—Sue Hagarman

[57] ABSTRACT

This is a safety strap for a light fixture. It is mounted on the body or shade under the light tubes. The safety strap keeps the tubes from falling out of the light possibly from incorrect installation of tubes or someone may bump the light causing the tubes to fall which may result in injury not only from broken and sharp glass but also harmful gasses that escape from the broken tubes, thus injury may be prevented if the safety strap is used.

2 Claims, 1 Drawing Sheet

SAFETY STRAP

HOW IT IS INSTALLED

Installation is done by simply drilling a ¼ hole in the shade or body and choosing the correct length which is determined by the width of the shade or body and snapping it in place with the supplied snap.

DRAWING

DESCRIPTION OF THE PREFERRED EMBODIMENT

Figure 3:
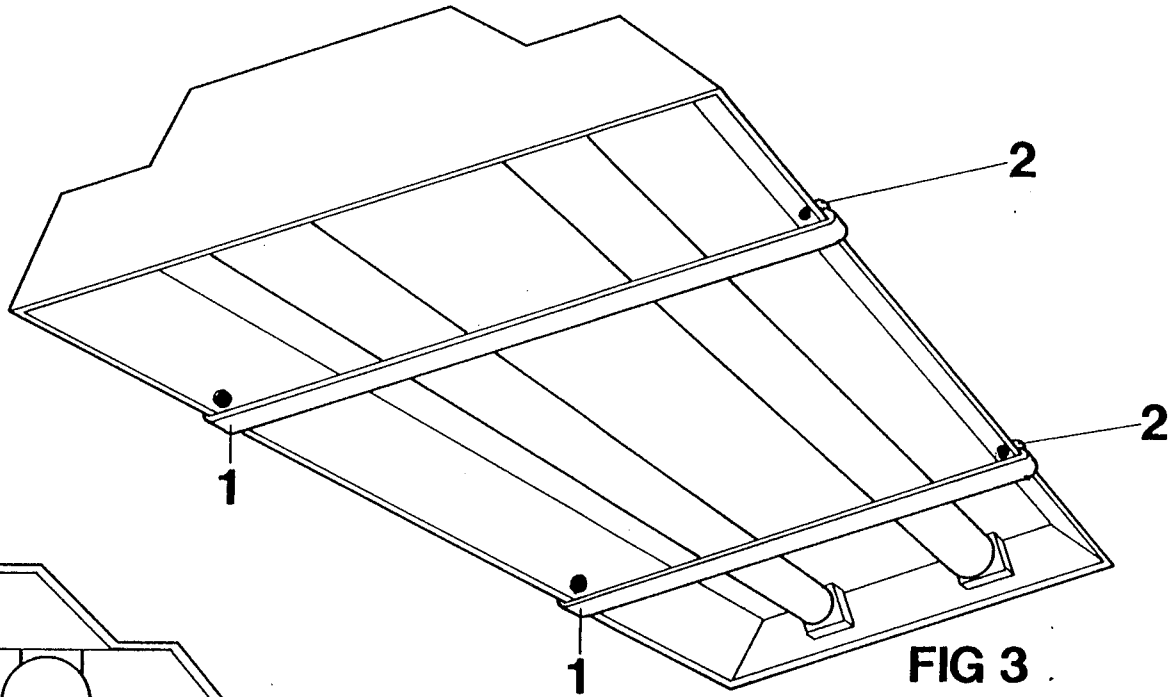
FIG. 3 shows the safety strap.
Figure 2:
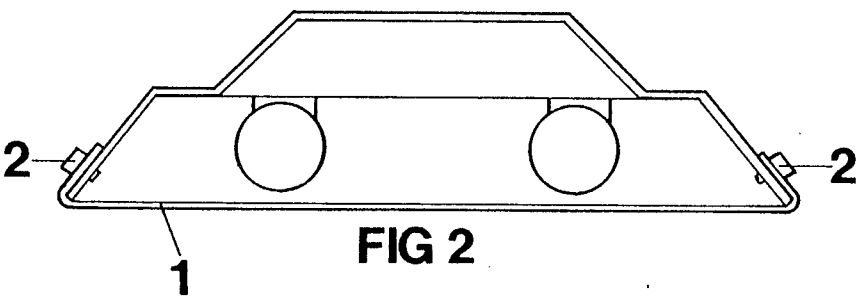
FIG. 2 is the end view of the fixture with one strap attached.
Figure 1:
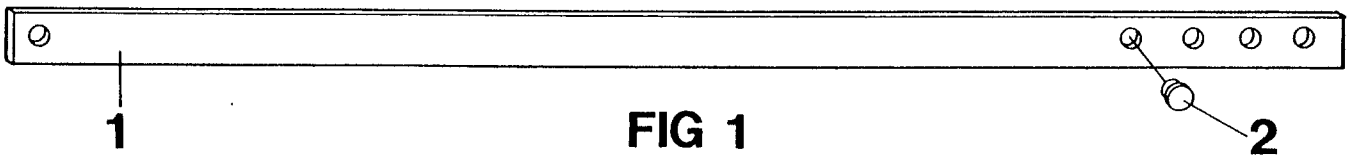
FIG. 1 shows view of the underside of the fluorescent light fixture and how the strap is attached.

The safety strap can be made from nylon, plastic or other materials. It has holes in it to adjust for different width lights. There are fastners or snaps to secure the strap to the fixture. Holes are on both sides of the body or shade in the front and rear to attach the strap to. Once the strap is attached the lights cannot fall to the ground unless purposely removed past the straps.

The strap is universal "one size fits all. " There are enough holes in the strap to accommodate the narrowest fixture to the widest. A ¼ drill bit and drill are the only tools needed to convert the standard fixture to the safety strap idea.

These straps will prevent a possible safety hazzard associated with changing fluorescent tubes or having one slip out of the socket due to socket breakage or incorrect installation of tube. The tube could fall to the ground and not only break into many sharp pieces of glass but harmful gases will escape and could result in a health hazzard.

BENEFITS/ADVANTAGES

Keeps the tube from falling to the ground causing injury from broken glass or hazardous gases escaping into the atmosphere. Also, ease of installation of the tube by supporting it while one twists the tube in place.

What is claimed is:

1. A safety strap for use with an elongate light fixture, wherein said light fixture is comprised of an elongate, substantially U-shaped reflector having two ends and containing therein elongate fluorescent light bulbs, and having attachment means located on said reflector proximate each of said reflector ends; and wherein said safety strap is comprised of two elongate, flexible straps having fastening means at each end thereof, wherein said fastening means attach to said attachment means so that said straps extend across the width of said reflector, beneath said bulbs, and proximate each of said reflector ends, thereby acting as guard means to prevent falling bulbs from exiting the light fixture.

2. The safety strap as claimed in claim 1 wherein said straps serve as bulb support during servicing of said light fixture.

* * * * *